US008287624B2

(12) United States Patent
Meisel

(10) Patent No.: US 8,287,624 B2
(45) Date of Patent: Oct. 16, 2012

(54) AIR ELUTRIATION DEVICE AND METHOD FOR DETECTING A FILTER ELEMENT IN AN AIR ELUTRIATION DEVICE

(75) Inventor: Ingo Meisel, Waldshut-Tiengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 392 days.

(21) Appl. No.: 12/635,766

(22) Filed: Dec. 11, 2009

(65) Prior Publication Data

US 2010/0147145 A1 Jun. 17, 2010

(30) Foreign Application Priority Data

Dec. 16, 2008 (DE) ..... 10 2008 054 775

(51) Int. Cl.
*B01D 46/46* (2006.01)

(52) U.S. Cl. ..... 95/1; 95/25; 96/417; 96/423

(58) Field of Classification Search ..... 95/1, 25; 96/423, 417; 422/114, 186.07; 210/195.3, 210/512.3; 73/863.22, 863.23
See application file for complete search history.

(56) References Cited

U.S. PATENT DOCUMENTS

| | | | | |
|---|---|---|---|---|
| 6,869,468 | B2 * | 3/2005 | Gibson | 96/224 |
| 2003/0121419 | A1 | 7/2003 | Gibson | |
| 2007/0059225 | A1 * | 3/2007 | Willette | 422/186.3 |

FOREIGN PATENT DOCUMENTS

| | | | |
|---|---|---|---|
| DE | 102004058390 | A1 | 6/2006 |
| DE | 102006008265 | A1 | 8/2007 |
| EP | 1798481 | A2 | 6/2007 |

* cited by examiner

*Primary Examiner* — Jason M Greene

*Assistant Examiner* — Karla Hawkins

(74) *Attorney, Agent, or Firm* — James E. Howard; Andre Pallapies

(57) ABSTRACT

An air elutriation device for an air conveying household appliance includes a housing with an air elutriation zone delimited by a filter element, a detection element in a storage space for the filter element, and a cover sheet on the filter element. The detection element can be actuated via the filter element by the cover sheet.

30 Claims, 5 Drawing Sheets

AIR ELUTRIATION DEVICE AND METHOD FOR DETECTING A FILTER ELEMENT IN AN AIR ELUTRIATION DEVICE

BACKGROUND OF THE INVENTION

The present invention relates to an air elutriation device and a method for detecting a filter element in an air elutriation device.

For the purpose of air elutriation, treatment by means of oxygen activation is utilized in addition to simple filtering. This type of air elutriation is described in DE 10 2006 008265 A1, for example. This and other types of air elutriation involve the formation of harmful gases such as ozone, for example. However, the ozone which is essential for the purification process must not escape from the appliance, since this would result in at least an odor nuisance for the user, and even physical complaints in the worst case. Activated carbon filters are used for this purpose. In this case ozone that is present in the air is trapped by the activated carbon. The activated carbon undergoes an aging process, which requires the regular replacement of the activated carbon. The replacement is performed by the user at the location where the appliance is installed. This requires partial disassembly of the appliance in order to gain access to the activated carbon. For safety reasons, in particular to prevent the escape of ozone from the appliance, it must not be possible to operate the appliance without the necessary activated carbon. Although provision can be made, as is usual, to warn against these hazards by means of suitable warnings in the user guide, this alone is not considered to be sufficient as a measure.

The prior art discloses devices in which provision is made for the user independently to perform maintenance tasks.

Thus, DE 10 2004 058 390 A1, for example, discloses a vapor extraction device comprising a filter arrangement which is situated in the housing of the vapor extraction device and at least partially covers an exhaust opening that is located in the vapor extraction device.

In order to protect the user against contact with the operating fan, provision is made for interrupting the current supply to the fan if there is no contact between the filter arrangement and the housing. For this purpose, a switching means is provided at the exhaust opening and is arranged at the contact surface between the filter arrangement and the housing. In particular, the filter arrangement comprises a filter cartridge and a frame which is made of sheet metal.

BRIEF SUMMARY OF THE INVENTION

The disadvantage of this arrangement is that the concept can only be applied to filter elements which have a rigid frame. However, activated carbon is generally supplied in the form of thick mats whose rigidity does not allow actuation of a switching means.

An exemplary embodiment of the invention addresses the problem of providing a solution for monitoring the presence and correct installation of an activated carbon filter in an auxiliary appliance for a vapor extraction hood.

The present invention is based on the knowledge that this problem can be solved by monitoring the installation of the filter element by means of a further component.

According to an exemplary embodiment of the invention, this problem is solved by an air elutriation device for an air conveying household appliance, wherein the device has a housing in which an air elutriation zone is formed and is delimited at least partially by at least one filter element, and at least one detection element. The air elutriation device is characterized in that the detection element is arranged at least partly in a storage space for the filter element, and the detection element can be actuated via the filter element by a cover sheet which is mounted on at least part of the filter element.

The air conveying household appliance according to an exemplary embodiment of the present invention is preferably a vapor extraction device, in particular a vapor extraction hood. The air elutriation device represents an auxiliary appliance in relation to the air conveying household appliance, and is preferably arranged separately from the household appliance and only connected to it via air conveying ducts. The housing of the air elutriation device therefore has at least one air inlet opening via which air from the air conveying household appliance, in particular the vapor extraction hood, can be conveyed for elutriation in the air elutriation device. Furthermore, at least one air outlet is provided on the housing. The air outlet is preferably formed by openings in at least one of the housing walls. In a particularly preferred embodiment, the openings are provided in the cover sheet. The cover sheet preferably covers the filter element to a large extent. The filter element is provided at least in the region of the air outlet, e.g. the region which has openings in a housing wall. Consequently, the filter element at least partially delimits the air elutriation zone in the housing. The further boundaries of the air elutriation zone are formed by further housing walls, in which no further openings are provided apart from the air inlet. The air elutriation preferably takes place in the air elutriation zone. Alternatively, however, it is also possible simply to convey the air for purification through the air elutriation zone in order to remove the impurities therefrom at the filter element. The filter element is preferably an activated carbon filter.

The detection element according to an exemplary embodiment of the present invention is used to recognize both the presence and correct installation of the filter element. In the following this is also referred to as recognition of the filter element. The recognition of the filter element is preferably done via actuation of the detection element. If the filter element is not present or is incorrectly installed, unpurified air or air elutriation treatment agents such as ozone, for example, can escape from the air elutriation zone into the environment. This is undesirable. As a result of the absence or incorrect installation of the filter element, as determined by the detection element, it is possible to output a warning or initiate other measures at the air elutriation device.

The storage space for the filter element is provided in the housing of the air elutriation device. The storage space is preferably delimited on four sides by walls of the housing and on a further side by a support element that is incorporated in the housing. The detection element is arranged in such a way that, with the components required for the detection or recognition of the filter element, it points in the direction of the storage space. In a particularly preferred embodiment, an actuation element of the detection element projects into the storage space.

According to an exemplary embodiment of the invention, actuation of the detection element does not occur if the filter element alone is inserted in the storage space. Instead, the presence of both the filter element and the cover sheet is required for actuation of the detection element. As the detection element can be actuated via the filter element by the cover sheet, which is mounted on at least part of the filter element, the presence or provision of both components, cover sheet and filter element, can be monitored using a single detection element. The cover sheet is preferably provided with air outlet openings, via which the air that has been purified by the filter element can leave the air elutriation device. The cover sheet therefore forms part of the housing of the air elutriation device.

An exemplary embodiment of the present invention makes it possible to allow for different states which the filter element can assume in the storage space. As a result, in addition to simply recognizing the presence of the filter element, the correct installation of the filter element can also be reliably monitored by the detection element. In particular, the position or the choice of sensitivity of the detection element in the inventive air elutriation device can be selected such that it only recognizes an installed state or operating state of the filter element, i.e. it is only actuated in this state. In a further state, which can be referred to as a fixing state, the detection element is not actuated and corresponding measures can be initiated. Unlike the prior art switching means, in which the introduction of a filter arrangement into a housing automatically results in an actuation of the switching means, reliable recognition of the filter element is possible in the case of the air elutriation device according to the invention.

A fixing state is understood to be a state of the filter element in which said filter element is introduced into the storage space, but the dimensions, geometry and/or position of the filter element do not yet correspond to the requirements for the operation of the air elutriation device. In particular, a gap between one or more of the boundaries of the storage space and the filter element may be present in the fixing state. In the fixing state, the margins of the filter element are preferably introduced into holders at the margin of the storage space. Additionally or alternatively, the filter element rests on a support device inside the housing when in the fixing state. In the fixing state, the deviation from the requirements for the operation of the air elutriation device cannot usually be recognized from the exterior by examining the filter element. As a result there exists the danger that the user will try to start up the air elutriation system despite the state of the filter element being incorrect.

In the installed state or operating state, however, the filter element is held in the storage space in such a way that it preferably fits closely against all of the boundaries of the storage space. In particular, the cover sheet fits closely against the filter element and holds this firmly in the storage space. In the operating state, the filter element preferably fits closely against the boundaries of the storage space on all sides.

According to an embodiment, the detection element is arranged in such a way that it is distanced from the filter element when the cover sheet is removed. The detection element is preferably attached at that margin of the storage space at which the filter element is distanced from the margin of the storage space in the fixing state. This embodiment is advantageous in particular in the case of detection elements that are actuated by touch, because the filter element is not recognized in the fixing state. The distance between the detection element and the filter element closes when the cover sheet is mounted on the filter element and the filter element is brought into the installed state as a result. There may be some movement or deformation of the filter element as part of this activity, and this is explained in greater detail subsequently.

Alternatively or additionally to the arrangement of the detection element at a distance from the filter element in the fixing state, the detection element can be selected such that it requires an actuation force which is greater than the force exerted on the detection element by the filter element when the cover sheet is removed. In this case the detection element is preferably a mechanical element such as a button or a plunger, for example. Alternatively, the detection element can also be e.g. a pressure sensor whose sensitivity is adjusted correspondingly. The cover sheet is considered to be removed when it does not fit closely against the filter element or is not properly fastened to the housing of the air elutriation device. Within the meaning of the present invention, the actuation force required by the detection element is understood to be the force which must be applied to the detection element in order to actuate it, i.e. in order that it recognizes the filter element. In the case of a mechanical element, this force constitutes the switching force that must be applied in order to overcome counter forces, e.g. spring forces that are exerted by the mechanical element. The force which is exerted on the detection element by the filter element in the storage space when the cover sheet is taken off or removed can be generated by the weight of the filter element, for example. The filter element can also exert a certain force on the detection element by virtue of its geometry and rigidity.

As the actuation force is selected to be greater than the force that can be applied by the filter element when the cover sheet is removed, it is possible reliably to prevent the filter element from being recognized if it is not yet in the installed state.

The filter element preferably consists of a deformable filter material and is in particular a filter mat of activated carbon. The present invention allows the use of such a filter material. In the case of plastic and/or elastically deformable filter elements there is a particularly great risk that although the filter element is situated in the storage space, it is not correctly installed. When using such a filter material it is also possible for the filter element to be deformed and moved as a result of a cover sheet being mounted, whereby the filter element can be brought into the installed state. In the case of a filter mat, the deformation of the filter element can be e.g. the decrease in the height of the mat due to compression. This increases the length and/or width of the mat, and the margins can therefore be pressed against the boundaries of the storage space for the filter element. Furthermore, the deformation of the filter element can be e.g. the elimination of a distortion of the filter element which occurred as a result of the action of the weight force before the cover sheet was mounted.

According to an embodiment, the cover sheet delimits the storage space for the filter element in at least one direction. In this case the cover sheet is preferably detachably fastened to at least one of the housing walls. In addition, the cover sheet has an air outlet. This can be formed by one or more openings in the cover sheet. The cover sheet delimits the storage space for the filter element in the housing on at least one side. By virtue of the cover sheet being a separate or separable component to the filter element, the exchange of the filter element is simplified because the cover sheet can be re-used after the filter change. The cover sheet and the filter element can together form a preassembled unit.

At a result of attaching the cover sheet, the filter element is brought from the fixing state into the installed state and/or held in the installed state. In particular, the filter element is moved into the installed position by the cover sheet. Additionally or alternatively, the shape of the filter element can be changed as a result of attaching the cover sheet. This is advantageous because the filter element is only recognized when it is in the installed state and therefore only when the cover sheet is provided at the housing.

By virtue of the inventive detection element additionally monitoring the presence of the cover sheet via the filter element it is possible to reduce or exclude not only the danger of unpurified air or pollutants escaping, but also the danger of contact between the user and electrical components inside the air elutriation device. In particular, the cover sheet provides protection against intervention by the user, since access to the interior of the housing is obstructed by the cover sheet.

The storage space is preferably formed on at least one side by a grid which is provided in the housing. This embodiment firstly ensures that air from the air elutriation zone can reach the filter element in the storage space. In addition, a grid also provides a support or seating surface for the filter element, thereby allowing the use of a flexible filter material. By virtue of the grid being provided in the housing it can remain in the housing when the filter element is removed for the purpose of filter replacement, thereby simplifying the replacement of the filter.

According to an embodiment, the dimensions of the filter element before insertion into the storage space are greater in at least one direction than the dimensions of the storage space in this direction after the cover sheet is mounted. By virtue of this design of the storage space it is possible for the filter element to be squeezed into the storage space, thereby increasing the dimension of the filter element in other directions. As a result of this, for example, it is possible to compensate for a distance between the margin of the filter element and a detection element, or a force can be exerted on a detection element which fits closely against the margin of the filter element.

According to a preferred embodiment, provision is made for at least one ozone generating component and/or at least one live element in the air elutriation zone. The present invention is particularly advantageous for air elutriation using ozone in particular, because the presence and correct installation of the filter element is necessary in the case of these devices, in order to prevent ozone escaping from the air elutriation zone by circumventing the filter element. Electrical components are used for generating the ozone. It is essential to prevent access to these components while they are in operation, in order to avoid any hazard to the user. Access to these electrical components and to other live elements during operation is prevented by the obligatory provision of the cover sheet in the present invention.

According to an embodiment, the detection element is a switch. The switch can be connected to a warning system. In this case, in the event that the detection element is not actuated, and it can therefore be established that a filter element (or a correctly installed filter element) is not present or that the cover sheet is missing, a warning can be output if the air elutriation device is started. In this case the switch is a break contact whose actuation results in the warning being cut off.

However, the switch is preferably provided in the voltage supply line to at least one live element and/or an ozone generating component. In this case, the switch is a make contact. Current is supplied to the live elements only when the switch is actuated. By virtue of the switch actuation inventively establishing that the filter element is in the installed state and the cover sheet is mounted, any contact between the user and live components is prevented. The ozone generating component likewise is only supplied with current if the filter element is in the installed state. In this state, the margins of the filter element fit closely against the boundaries of the storage space, and any escape of the ozone due to circumvention of the filter element can therefore be prevented.

According to an embodiment, the cover sheet forms at least two sides of the housing of the air elutriation device. In the case of such a cover sheet, which has an L shape, a filter element that is located underneath the cover sheet in the storage space can be held reliably in terms of shape and position, i.e. brought from a fixing state into an installed state and held there. In particular, the cover sheet can act on the filter element from two sides. In this case the filter element preferably has an L shape also. In addition, the use of a cover sheet which forms two sides of the housing is advantageous because the size of the surface via which purified air can emerge from the filter is enlarged as a result.

According to a further aspect, the invention relates to a method for detecting a filter element in an air elutriation device for an air conveying household appliance, wherein said device has an housing with an air elutriation zone which is formed therein and is delimited at least partially by at least one filter element, and at least one detection element. The method is characterized in that the detection element recognizes the filter element by means of a cover sheet which is mounted on at least part of the filter element.

According to an exemplary embodiment of the present invention, the mounting of the cover sheet is recognized by virtue of the filter element being in an installed state, said filter element being brought into or held in the installed state by the cover sheet. Since the present invention provides for the presence of a cover sheet to be taken into consideration when recognizing the filter element, it is thereby ensured that a filter element is only recognized if it is correctly installed in the housing. In addition, access to the interior of the housing is prevented by the cover sheet.

In a particularly preferred embodiment, the mounting of the cover sheet brings the filter element from a fixing state into an installed state and/or holds it in the installed state.

In a preferred embodiment, the connection of a power supply to at least one component of the air elutriation device is established when the filter element is recognized by the detection element. As a result of this, for example, ozone can be generated by one of the components. There is no risk of the ozone escaping in this context, since the recognition of the filter element establishes its presence and correct installation. Moreover, the recognition of the filter element also establishes the presence and correct attachment of the cover sheet, since this is a prerequisite for the recognition of the filter element.

In a preferred embodiment, the connection of a power supply to at least one component of the air elutriation device is interrupted by the detection element if the filter element is withdrawn or the cover sheet is removed. In particular, the power supply of the ozone generating element is interrupted. As a result of this, it is possible to ensure that no ozone is generated.

Additionally or alternatively, when the filter element is recognized according to the present invention, a warning signal which is output when the filter element is missing or is incorrectly installed in the housing can be switched off.

The method according to an exemplary embodiment of the invention is preferably carried out in conjunction with an air elutriation device according to the invention.

Advantages and features which can be described in relation to the inventive air elutriation device apply—where applicable—correspondingly to the inventive method and vice versa.

According to an exemplary embodiment of the invention, the cover sheet prevents the hazard of the user gaining access to live parts, and the activated carbon filter prevents the hazard of ozone escaping from the appliance. In order that the activated carbon filter can be replaced, it must be possible to remove the cover sheet and the activated carbon filter from the air elutriation device. By virtue of a detection element embodied as a switching element, in particular a pushbutton switch which can be implemented as a make contact, closing the electrical circuit and allowing the production of ozone when the complete appliance is correctly assembled, it is ensured that both the cover sheet and the activated carbon filter are used during reassembly. By virtue of the inventive construction and arrangement of the switch in the housing, a single switching element is sufficient to cover both of the aforementioned safety considerations simultaneously. This also results in a cost reduction thanks to the decrease in the number of components. The switching element is only actuated when both the cover sheet and the activated carbon filter are installed at the same time. If either of the two parts is missing, the switching element remains unactuated.

If the specifications are ignored and only the cover sheet is installed, without the activated carbon filter, the switching element remains unactuated and the air elutriation device cannot be started. Conversely, if only the activated carbon filter is installed, without the cover sheet, the switching element is likewise not actuated because the activated carbon filter, due to its generally insufficient dimensional stability and the considerable switching forces required by the switching element, is not capable of actuating the switching element without the supporting form of the cover sheet. The switching element, on the other hand, is actuated reliably if the appliance is assembled according to the specifications.

BRIEF DESCRIPTION OF THE DRAWINGS

The invention is described in greater detail below with reference to an exemplary embodiment and the appended figures, in which.

DETAILED DESCRIPTION OF EXEMPLARY EMBODIMENTS OF THE PRESENT INVENTION

Figure 1:
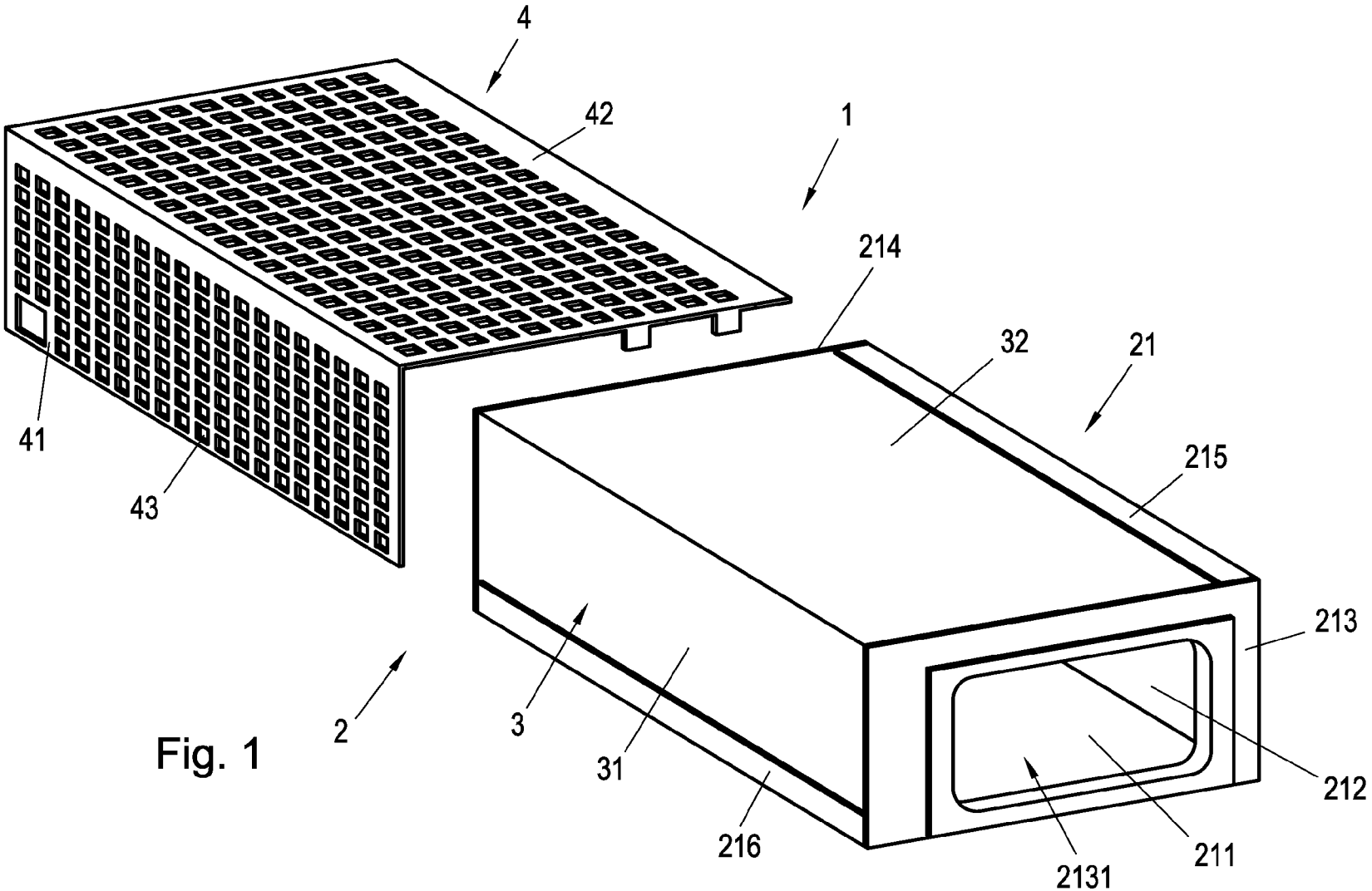
FIG. 1 shows a schematic perspective view of an embodiment of an air elutriation device according to the invention in an exploded view.

The air elutriation device 1 shown in FIG. 1 has a box-shaped housing 2. The housing 2 is made of a base part 21 and a cover sheet 4. The base part 21 comprises a floor 211, a rear wall 212, and two side walls 213 and 214. The base part 21 is produced by bending sheet metal, for example. An air inlet 2131 is provided in the side wall 213 that is visible in FIG. 1.

A forward-projecting flange 215 is provided at the top edge of the rear wall 212 of the housing 21. The flange 215 runs parallel relative to the floor 211 of the base part 21. In addition, an upward-projecting flange 216 is provided at the front edge of the floor 211. A filter element 3 is held on the base part 21 by the flanges 215 and 216. The filter element 3 has an L shape in the embodiment shown. One L limb forms the front side 31 of the filter element 3 and the other L limb forms the top side 32 of the filter element 3. The rear margin of the top side 32 of the filter element 3 is pushed under the flange 215 which extends from the rear wall 212 of the base part 21. The bottom margin of the front side 31 of the filter element 3 is pushed behind the flange 216 which extends from the floor 211. The side margins of the filter element 3 fit closely against the side walls 213 and 214.

The cover sheet 4 is shown separately from the base part 21 in FIG. 1. This also has an L shape. One L limb forms the front side 41 of the cover sheet 4 and the other L limb forms the top side 42 of the cover sheet 4. Air outlet openings 43 are provided in a distributed manner on the top side 42 and the front side 41 of the cover sheet 4. The cover sheet 4 and the base part 21 together form the housing 2.

Figure 2:
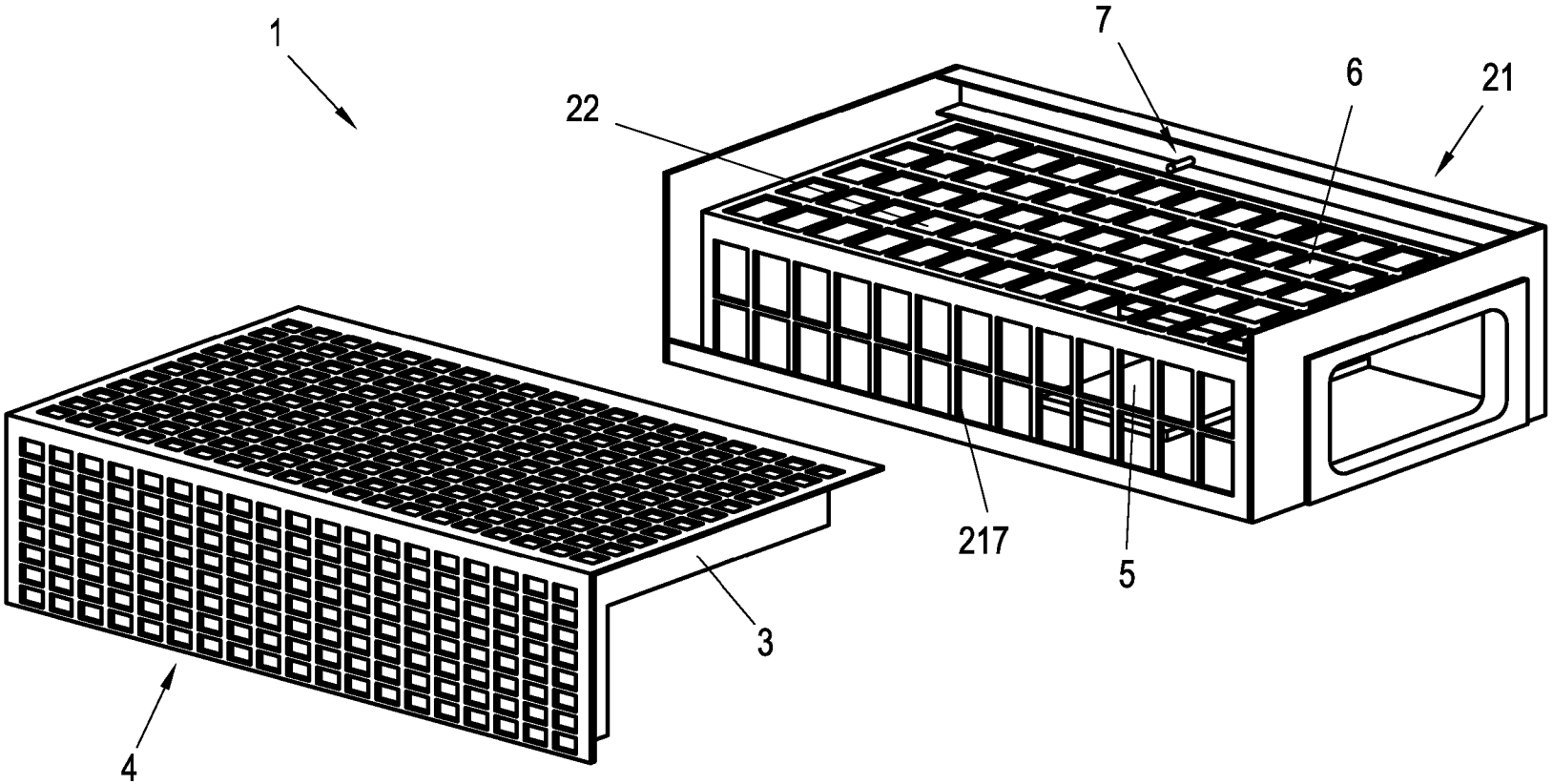
FIG. 2 shows a schematic perspective view of an embodiment of an air elutriation device according to the invention in a further exploded view.

FIG. 2 shows the air elutriation device 1 with the filter element 3 removed. The filter element 3 is provided on the inner side of the cover sheet 4 and forms a preassembled unit with said cover sheet 4. A support grid 217 which likewise has an L shape is provided in the base part 21. The air elutriation zone 22 below the support grid 217 can be seen through the support grid 217 in FIG. 2. An ozone generating component 5 and other live components 6 are schematically indicated in this air elutriation zone 22 which is formed between the floor 211, the side walls 213, 214 and the rear wall 212 and the support grid 217. A detection element 7 is arranged on the rear wall 212 of the base part 21 above the support grid 217. The detection element 7 is arranged in the center of the width of the base part 21.

Figure 3:
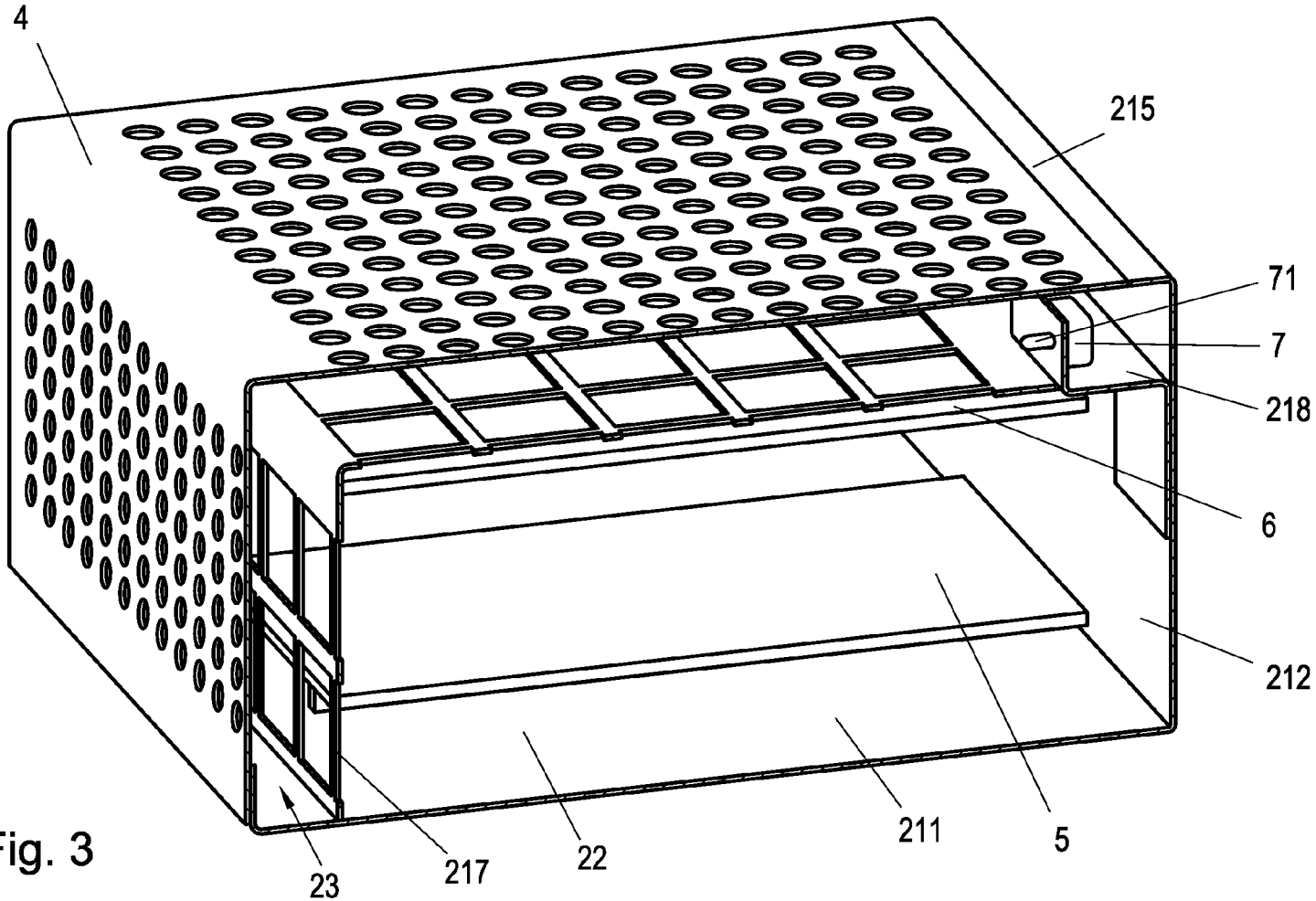
FIG. 3 shows a schematic perspective view of the interior of the embodiment of the air elutriation device according to FIGS. 1 and 2 without a filter element.

The principle of operation of the detection element 7 is explained below with reference to FIGS. 3 to 5.

The detection element 7 is attached to a ridge 218 which projects forward from the rear wall 212 of the base part below the flange 215. The detection element 7 has a forward facing contact driver 71 or contact/actuating pin.

The support grid 217 is also fastened to the ridge 218. The cover sheet 4 is fastened to the flange 215, e.g. by means of catching. The dimension of the support grid 217 in the depth direction of the air elutriation device 1 is smaller than the dimension of the floor 212 and the cover sheet 4 in this direction. A storage space 23 in which the filter element 3 can be held is thus formed between the support grid 217 and the cover sheet 4. If the filter element 3 is not inserted in the storage space 23, as shown in FIG. 3, the detection element 7 is not actuated.

Figure 4:
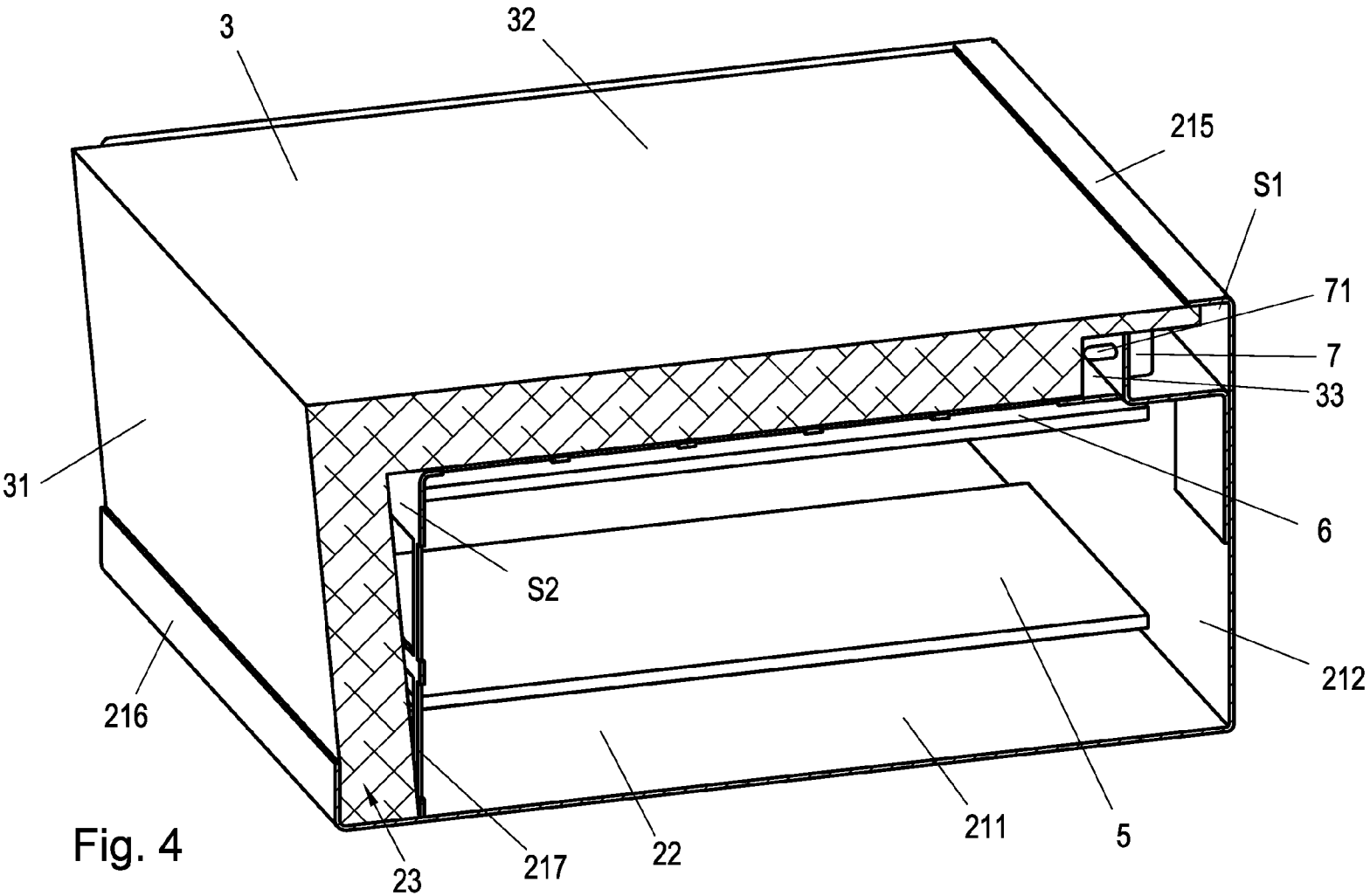
FIG. 4 shows a schematic perspective view of the interior of the embodiment of the air elutriation device according to FIGS. 1 and 2 with a filter element and without a cover sheet.

In the case shown in FIG. 4, the filter element 3 is attached to the base part 21 but the cover sheet 4 is not. Due to the limited dimensional stability of the filter element 3, the rear margin of the top side 32 of the filter element 3 does not fit closely against the rear wall 212 of the base part 21. Instead, there is a gap S1 between the margin of the top side 32 of the filter element 3 and the rear wall 212 of the base part 21. Likewise, the inner side of the filter element, in particular the inner side of the front side 31 of the filter element 3 does not fit closely against the front side of the support grid 217. A gap S2 exists here. The gap S2 tapers from the upper end of the inner side of the front side 31 of the filter element 3 to the lower end which stands on the floor 211 of the base part 21 and is pushed in between the support grid 217 and the flange 216 and held there. The state of the filter element 3 shown in FIG. 4 is also referred to as the fixing state. In this state, the top side 32 of the filter element 3 is pushed forward, thereby creating the gaps S1 and S2. Ozone or other pollutants or odorous substances generated in the air elutriation zone 22 can escape, in particular via the gap S1 between the flange 215 and the filter element 3, and be released into the environment.

An indentation 33 is incorporated from below in the rear margin of the top side 32 of the filter element 3. The detection element 7 is accommodated in this indentation 33. Since the top side 32 of the filter element 3 is pushed forward, the rear side of the filter element 3 in the fixing state shown in FIG. 4 does not come into contact with the contact driver 71 or at least cannot actuate it due to the actuation/switching force that is required.

Figure 5:
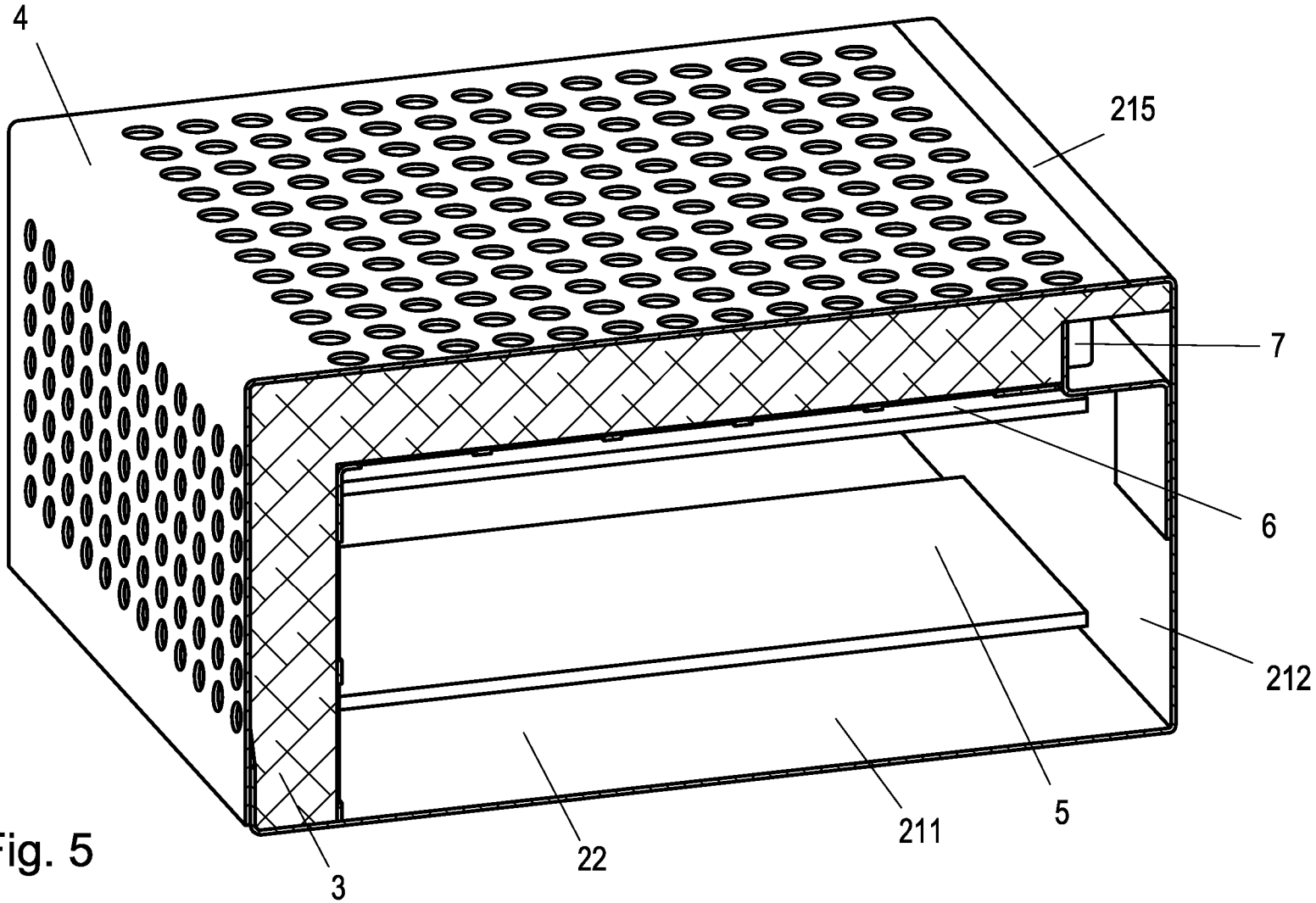
FIG. 5 shows a schematic perspective view of the interior of the embodiment of the air elutriation device according to FIGS. 1 and 2 with filter element and cover sheet.

The detection element 7 is only actuated in the installed state or operating state of the filter element 3 shown in FIG. 5. In this state, the cover sheet 4 is mounted on the filter element 3 and fastened to the base part 21. By virtue of the cover sheet 4, the filter element 3 is pressed into its intended L shape. In particular, the gaps S1 and S2 are closed. The cover sheet 4 can be fastened to the base part 21 by means of hooking, insertion or catching. The dimensional stability of the cover sheet 4 exerts a force on the filter element 3, bringing it from the fixing state shown in FIG. 5 into the installed state. By virtue of the filter element 3 being pushed rearward and hence in the direction of the detection element 7, the rear side of the filter element 3 comes into contact with the detection element 7 in such a way that the latter is actuated.

The detection element 7 can be designed as a switch, in particular a make contact. In this case, an electrical circuit is closed when the detection element 7 is actuated, in particular when there is contact with and movement of the contact driver 71. The live components 6 and the ozone generating component 5, for example, are connected to the electrical circuit. If the electrical circuit is closed due to actuation of the detection element 7, as in the state shown in FIG. 5, ozone is generated and the air introduced into the air elutriation zone 22 can be purified thereby. Any escape of ozone from the air elutriation zone 22 as a result of circumventing the filter element 3 is prevented in this type of configuration. In the states shown in FIGS. 3 and 4, however, the detection element 7 is not actuated and the electrical circuit is therefore not closed. In these states, therefore, ozone is not generated and none of the live components is supplied with power. It is therefore possible to prevent any escape of ozone or unintentional contact of the user with a live component.

The present invention is not restricted to the illustrated embodiment. For example, the filter element can be embodied without a recess on the underside. Furthermore, the detection element can have a different structure and/or be placed in a different position, e.g. on the top side or the front side of the support grid.

By virtue of the structure according to the present invention it is ensured firstly that the user does not gain access to live parts when replacing the filter element, and secondly that the air elutriation device cannot be operated without the activated carbon which preferably forms part of the filter element and is required for safety reasons, in particular to prevent the escape of ozone from the appliance.

The inventive air elutriation device comprising electrical and ozone generating components can automatically ensure that all of the functionally relevant and safety-relevant appliance parts for protection against ozone escape and against access to electrically active parts are installed and included in the complete appliance assembly according to the specifications. If this is not the case, the air elutriation device will automatically remain inoperative until the complete appliance assembly according to the specifications is established.

Safety instructions are usually included in installation and user guides, but there are no means of checking compliance in relation to these instructions. The inventive safety concept provides for checking to extend beyond mere recommendations, wherein said checking now includes the operation of the appliance by the user, and can prevent or at least significantly impede negligent handling and to some extent also deliberate misuse or improper operation. The probability of serious accidents can be reduced in this way.

What is claimed:

1. An air elutriation device for an air conveying household appliance comprising:

a housing with an air elutriation zone delimited by a filter element, said filter element including a filter material;

a detection element in a storage space for the filter element and accessible for direct contact with the filter material of the filter element; and a cover sheet on the filter element, wherein the detection element can be actuated via the filter element by the cover sheet.

2. The air elutriation device of claim 1, wherein the detection element is distanced from the filter element when the cover sheet is removed.

3. The air elutriation device of claim 1, wherein the detection element requires an actuation force which is greater than a force that is exerted by the filter element on the detection element when the cover sheet is removed.

4. The air elutriation device of claim 1, wherein the filter element comprises a deformable filter material and comprises a filter mat of activated carbon.

5. The air elutriation device of claim 1, wherein the cover sheet delimits the storage space for the filter element in a direction.

6. The air elutriation device of claim 1, wherein the storage space comprises a grid on a side of the storage space in the housing.

7. The air elutriation device of claim 1, wherein the dimensions of the filter element before insertion in the storage space are greater in a direction than the dimensions of the storage space in this direction when the cover sheet is mounted.

8. The air elutriation device of claim 1, further comprising an ozone generating component and/or a live element in the air elutriation zone.

9. The air elutriation device of claim 8, wherein the detection element comprises a switch in a voltage supply line to the live element and/or an ozone generating component.

10. The air elutriation device of claim 1, wherein the cover sheet defines two sides of the housing of the air elutriation device.

11. A method for detecting a filter element in an air elutriation device for an air conveying household appliance, the device having a housing with an air elutriation zone delimited by a filter element made of filter material, a detection element, and a cover sheet on the filter element, the method comprising detecting the presence and/or correct installation of the filter element based on direct contact between the filter material of the filter element and the detection element, the cover sheet reinforcing the filter material to ensure engagement between the filter material and the detection element.

12. The method of claim 11, further comprising bringing the filter element from a fixing state into an installed state or holding the filter element in the installed state with the cover sheet being mounted.

13. The method of claim 11, further comprising connecting a power supply to a component of the air elutriation device when the filter element is recognized by the detection element.

14. The method of claim 11, further comprising interrupting the connection of a power supply to a component of the air elutriation device with the detection element when the filter element is withdrawn of the cover sheet is removed.

15. An air elutriation device for an air conveying household appliance comprising:

a housing with an air elutriation zone delimited by a filter element, said filter element including a filter material;

a detection element in a storage space for the filter element and accessible for direct contact with the filter material of the filter element; and a cover sheet on the filter element, the cover sheet being structured and positioned to support and/or reinforce the filter element so as to ensure that the filter material directly actuates the detection element.

16. The air elutriation device of claim 15, wherein the detection element is distanced from the filter element when the cover sheet is removed.

17. The air elutriation device of claim 15, wherein the detection element requires an actuation force which is greater than a force that is exerted by the filter element on the detection element when the cover sheet is removed.

18. The air elutriation device of claim 15, wherein the filter element comprises a deformable filter material and comprises a filter mat of activated carbon.

19. The air elutriation device of claim 15, wherein the cover sheet delimits the storage space for the filter element in a direction.

20. The air elutriation device of claim 15, wherein the storage space comprises a grid on a side of the storage space in the housing.

21. The air elutriation device of claim 15, wherein the dimensions of the filter element before insertion in the storage space are greater in a direction than the dimensions of the storage space in this direction when the cover sheet is mounted.

22. The air elutriation device of claim 15, further comprising an ozone generating component and/or a live element in the air elutriation zone.

23. The air elutriation device of claim 22, wherein the detection element comprises a switch in a voltage supply line to the live element and/or an ozone generating component.

24. The air elutriation device of claim 15, wherein the cover sheet defines two sides of the housing of the air elutriation device.

25. The air elutriation device of claim 15, wherein the housing includes a grid to support the filter element and to enclose an ozone generating element and/or at least one live element in the air elutriation zone.

26. The air elutriation device of claim 15, wherein the cover sheet and/or the filter element has/have an L-shape.

27. The air elutriation device of claim 15, wherein the cover sheet is structured to urge the filter material from a fixing state to an installed state and/or to hold the filter material in the installed state.

28. The air elutriation device of claim 15, wherein the filter material is generally of insufficient dimensional stability to actuate the switching element without support from the cover sheet.

29. The air elutriation device of claim 15, wherein the detection element is positioned and mounted on the housing.

30. An extraction hood;

an air conveying device to convey air along a path; and the air elutriation device of claim 1, wherein the housing includes at least one opening in communication with the path.

* * * * *